United States Patent [19]

Kobayashi

[11] Patent Number: 5,076,756

[45] Date of Patent: Dec. 31, 1991

[54] FULL-ARC ADMISSION STEAM TURBINE

[75] Inventor: Michio Kobayashi, Kawasaki, Japan

[73] Assignee: Fuji Electric Co., Ltd., Kawasaki, Japan

[21] Appl. No.: 630,750

[22] Filed: Dec. 20, 1990

Related U.S. Application Data

[63] Continuation of Ser. No. 329,680, Mar. 28, 1989, abandoned.

[30] Foreign Application Priority Data

Mar. 29, 1988 [JP] Japan ..... 63-74969

[51] Int. Cl.[5] ..... F01D 17/00

[52] U.S. Cl. ..... 415/37; 415/39; 415/45

[58] Field of Search ..... 415/25, 37, 38, 39, 415/40, 44, 45, 181

[56] References Cited

U.S. PATENT DOCUMENTS

| | | | |
|---|---|---|---|
| 769,300 | 9/1904 | Brown | 415/40 |
| 818,008 | 4/1906 | Wilkinson | 415/38 |
| 1,399,215 | 12/1921 | Kerr | 415/44 |
| 2,718,349 | 9/1955 | Wilde | 415/44 |
| 2,728,518 | 12/1955 | Wilde et al. | 415/37 |
| 2,863,288 | 12/1958 | Martin | 415/44 |
| 4,325,670 | 4/1982 | Silvestri, Jr. | 415/44 |
| 4,604,028 | 8/1986 | Yeaple et al. | 415/44 |

*Primary Examiner*—Edward K. Look
*Assistant Examiner*—Hoang Nguyen
*Attorney, Agent, or Firm*—Brumbaugh, Graves, Donohue & Raymond

[57] ABSTRACT

The present invention relates to an full-arc admission steam turbine having its output controlled by regulating the opening of a steam regulating valve. The full-arc admission steam turbine is run at a higher efficiency than that of the full-arc admission steam turbine of the prior art by improving the drop in the internal efficiency of the turbine due to the throttle loss of the valve. Moreover, a substantially constant high efficiency is maintained for the time period from the designed point of a partial load to the rated load if the second blade stage group is selected to provide an internal efficiency substantially equal to that of the blade stage group of the prior art.

1 Claim, 3 Drawing Sheets

FULL-ARC ADMISSION STEAM TURBINE

This application is a continuation of application Ser. No. 329,680, filed on Mar. 28, 1989, now abandoned.

BACKGROUND OF THE INVENTION

The present invention relates generally to steam turbines and, more particularly, to the design of a blade stage structure of an full-arc admission throttle governing type steam turbine.

It is said that an overall improvement in the internal efficiency of a steam turbine could save a considerable amount of money in fuel costs if the internal efficiency could be improved by just 1%, as in the case of a 100 MW power plant. Therefore, if the internal efficiency could be improved by 1 to 2%, the power plant would pay for the additional cost of the hardware.

The prior art has classified steam plants having a constant input steam pressure from its running standpoint into two types, a plant that is run in a rated load operation and a plant that is run relatively frequently under a partial load, with an output of no more than the rated point. Since the former category is run at the rated operation, the full-arc admission throttle control type or "full-arc admission" steam turbine, has no control stage to lower its efficiency and is therefore more efficient and advantageous. On the other hand, the latter category is frequently run under partial load, and has a Curtis or Rateau stage as the control stage.

These control stages are more advantageous for partial loads when using a nozzle control as shown in FIG. 3.

An example of the prior art will be described with reference to FIG. 4, which is a diagram showing a partial structure of the full-arc admission steam turbine, and to FIG. 5 which is the pressure-output diagram of the turbine. In the full-arc admission steam turbine, the steam under a pressure $P_0$ is introduced through a first steam regulating valve 3 at a flow rate $G_0$ into a chamber at an introduction pressure $P'_1$ so that it generates power by turning a rotor 9 while expanding through a blade stage group 10. The output $N_P$ is deduced from the following formula:

$$N_P = G_0 \times \Delta i_0 / 0.86 \times \eta_{i(N)},$$

wherein:

$N_P$ is the output; $G_0$ is the amount of steam;

$\Delta i_0$ is the adiabatic heat drop (i.e., the enthalpy difference); and $\eta_{i(N)}$ is the internal efficiency of the turbine.

The relationship between the pressure and the output is generally proportional as plotted by the curve $P_1$ in the pressure-output diagram of FIG. 5.

FIG. 3 is a comparison diagram of the internal efficiency of the present invention as compared to the throttle and nozzle prior art. The diagram represents the relationship between the internal efficiency and the output. This is accomplished by plotting the internal efficiency ratio $\overline{N}$ and the output ratio $\overline{N}$ on the ordinate and abscissa, respectively, in percentages. In this diagram, the curve a represents the throttle governing type steam turbine of the present invention; the curve b represents the throttle governing type steam turbine of the prior art; and the curve c represents the nozzle cut-off governing type steam turbine.

It is further apparent from this diagram that the efficiency of the full-arc admission steam turbine of the prior art drops at 70% of output, as represented at P, the intersection between the curve b and the abscissa scale of 70%. Although the internal efficiency of the nozzle cut-off governing type steam turbine drops to a point q at most, the former turbine is less advantageous than the latter turbine. This is because the steam flow rate is controlled to reduce the output by throttling the steam regulating valve so that the internal efficiency drops due to the throttle loss of the valve.

As described above, the full-arc admission steam turbine of the prior art has an excellent efficiency in the rated load operation but is deficient, as shown by the drop in efficiency, for a partial load. The present invention overcomes this problem and provides an full-arc admission steam turbine the internal efficiency of which drops only marginally even under partial load.

SUMMARY OF THE INVENTION

According to the present invention, the turbine blade stages are divided into first and second blade stage groups and connected with a first and a second steam regulating valve. The turbine output is controlled by regulating the opening of the first steam regulating valve to a designed predetermined partial load and when the first steam regulating valve is fully opened to regulate the opening of the second steam regulating valve from the designed predetermined partial load to a full load.

Accordingly, the full-arc admission steam turbine is run at a higher efficiency than the prior art. This is accomplished by reducing the drop in the internal efficiency of the turbine due to the throttle loss of the valve. Moreover, a substantially constant high efficiency is maintained for the time period from the aforementioned design point of the partial load to the rated load if the second blade stage group is selected to provide an internal efficiency substantially equal to that of the blade stage group of the prior art.

BRIEF DESCRIPTION OF THE DRAWINGS

For convenience of reference, like components, elements and features in the various figures are designated by the same reference numerals or characters.

DETAILED DESCRIPTION OF THE INVENTION

Figure 1:
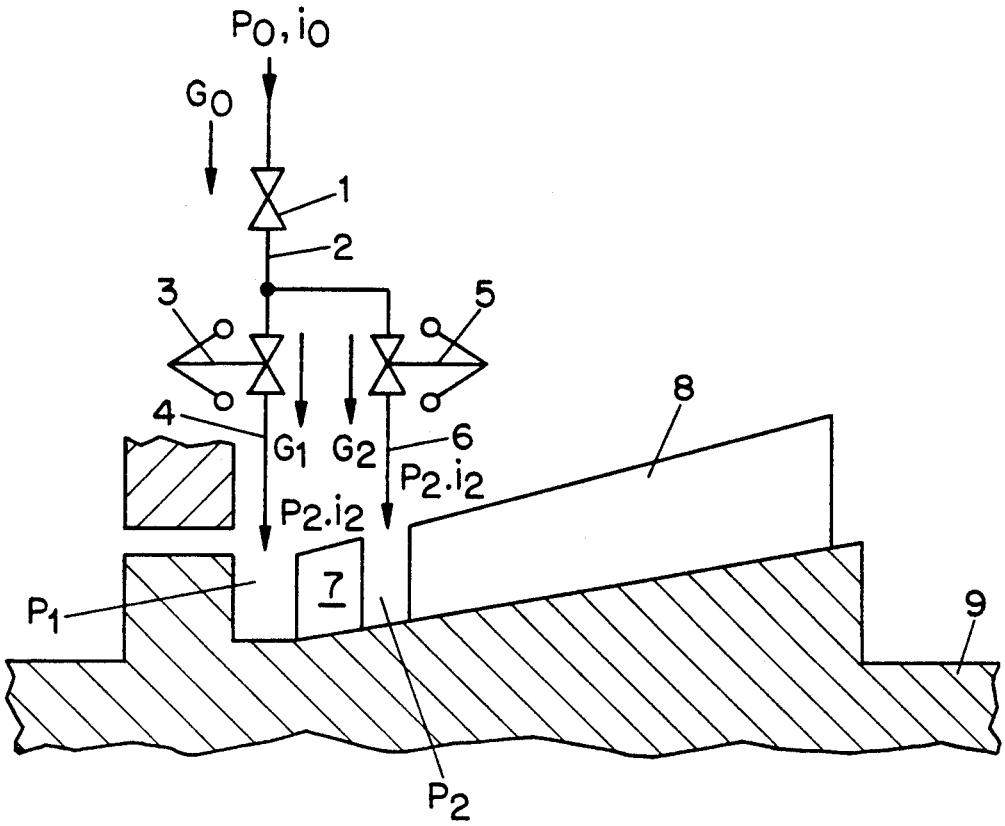
FIG. 1 is a diagram showing a portion of the structure of the full-arc admission steam turbine of the embodiment according to the present invention.
Figure 2:
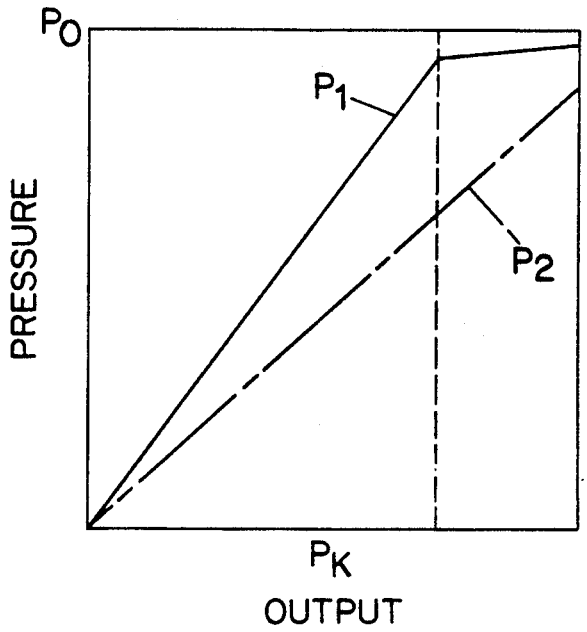
FIG. 2 is a pressure-output diagram of the embodiment.

The present invention will be described with reference to the drawings which show an embodiment of the full-arc admission steam turbine. FIG. 1 is a diagram showing a partial structure of the full-arc admission steam turbine of the embodiment. FIG. 2 is an output-pressure graph (or output-pressure diagram) of the full-arc admission steam turbine. Here, the parts shared between FIGS. 1 and 2 are designated as common reference characters.

In these Figures, reference numeral 9 designates a rotor which is arranged with two blade stage groups, a first blade stage group 7 and a second blade stage group 8. At the respective inlets, pressure points $P_1$ and $P_2$ of the blade stage groups, there are arranged first and second steam pipings 4 and 6, which are branched from a main steam piping 2 having a stop valve 1, to supply steam. The steam pipings 4 and 6 are equipped with respective steam regulating valves 3 and 5, the governing system of which, diagrammatically shown in FIG. 1, is conventional and may be any one of known mechanically drive, oil-pressure driven, or electrically driven hydraulic controls.

The blade stage of the full-arc admission steam turbine is designed so that steam is supplied by increasing the opening of the first steam regulating valve 3 of the first steam piping 4. The steam is then expanded at the first blade stage group 7 and at the second cascade group 8 to generate power so that the maximum internal efficiency may be exhibited with the full opening of the first steam regulating valve 3. In other words, the design point is selected to maximize the internal efficiency at the most effective partial load which is between 70 and 95%. The stage number and the blade length of the blade stage groups 7 and 8 are then determined.

The output N at this time is calculated by the following formula:

$$\text{Partial Load (at Design Point) } N \times (G_0 \times \Delta i_0)/0.86 \cdot i_{(P)},$$

wherein:

$G_0$ is the inlet steam amount; $\Delta i_0$ is the adiabatic heat drop; and $\eta i_{(P)}$ is the internal efficiency of the turbine.

Incidentally, the curve $P_1$ of FIG. 2 plots the chamber pressure when the first steam regulating valve 3 is adjusted. The stage number and blade length of the second blade stage group 8 are also selected to provide an internal efficiency substantially equal to that of the full-arc admission steam turbine of the prior art when the steam is supplied from the second steam piping 6, when the turbine is driven by the second blade stage group 8. As a result, the internal efficiency obtainable even under the rated load is substantially equal to that under the partial load.

The output in the rated load is obtained from the following formula:

$$\begin{aligned} N &= (G_i \times \Delta i_1)/0.86 \cdot \eta_1 + [(G_1 + G_2) \times \Delta i_2]/0.86 \times \eta_2 \\ &= (G_0 \times \Delta i_0)/0.86 \cdot \eta_{i(N)}, \end{aligned}$$

wherein:

$G_1$ is the steam amount of (introduced by) the first steam regulating valve; $G_2$ is the steam amount of the second steam regulating valve; $G_0 = G_1 + G_2$; $\Delta i_1$ is the adiabatic heat drop corresponding to $G_1$: $\Delta i_2$ is the adiabatic heat drop corresponding to $(G_1 + G_2)$; $\eta_1$ is the internal efficiency of the turbine corresponding to $G_1$; $\eta_2$ is the internal efficiency of the turbine corresponding to $(G_1 + G_2)$; and $\eta i_{(N)}$ is the internal efficiency of the turbine corresponding to the rated load.

Figure 3:
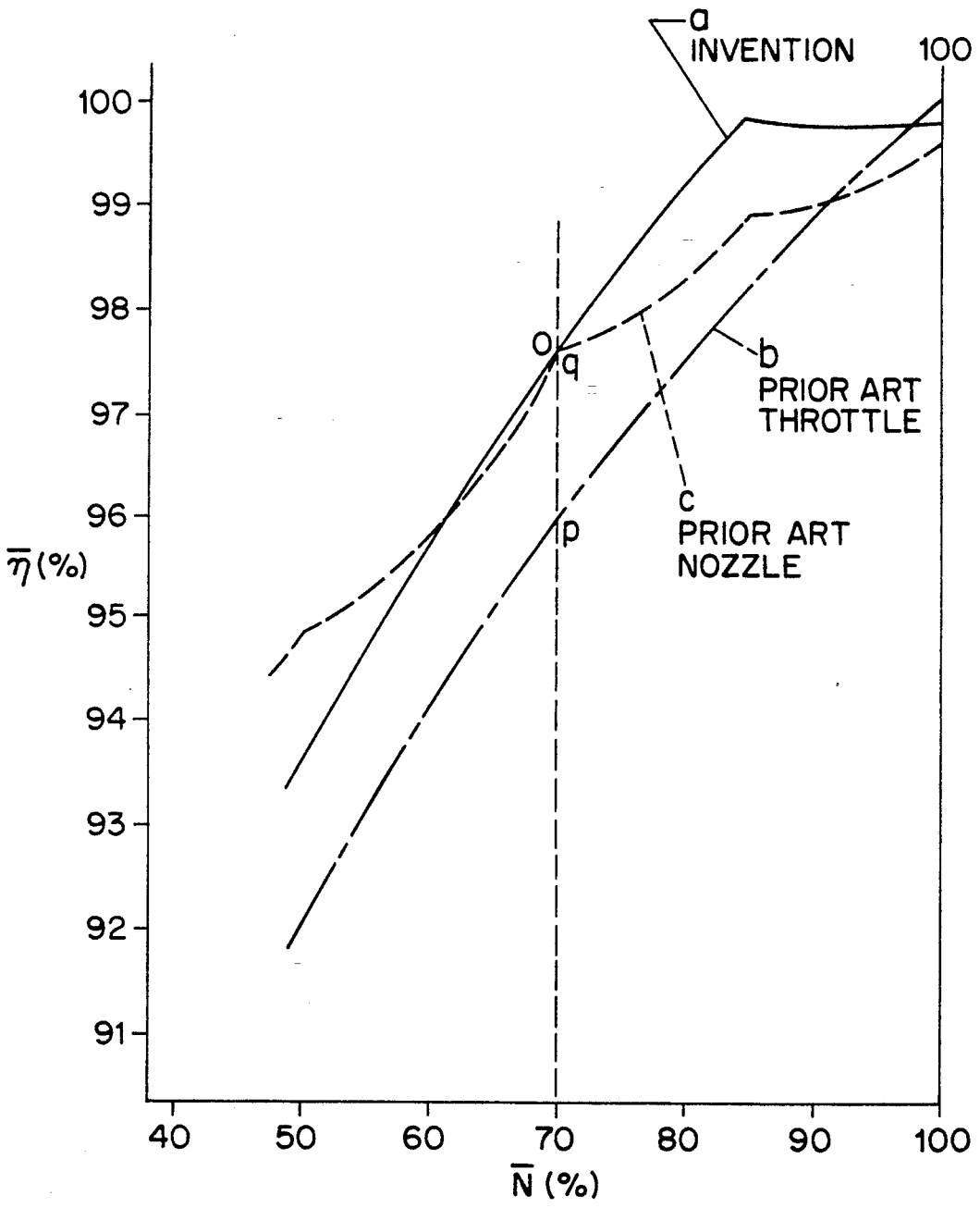
FIG. 3 is a diagram of the internal efficiency.
Figure 4:
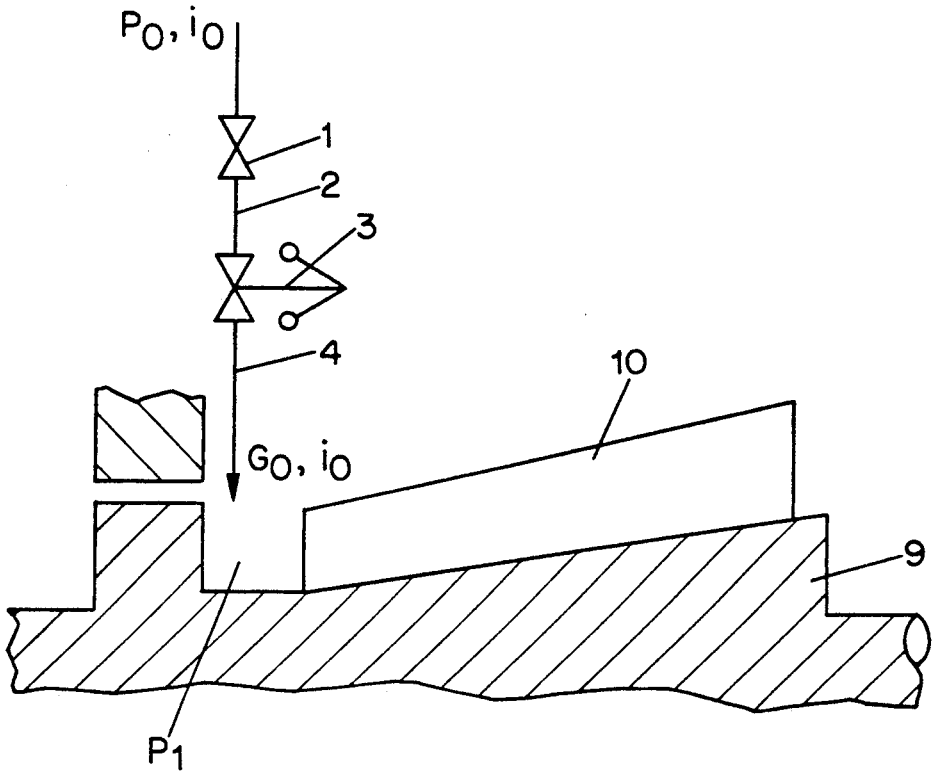
FIG. 4 is a diagram showing a portion of the structure of the full-arc admission steam turbine of the prior art.
Figure 5:
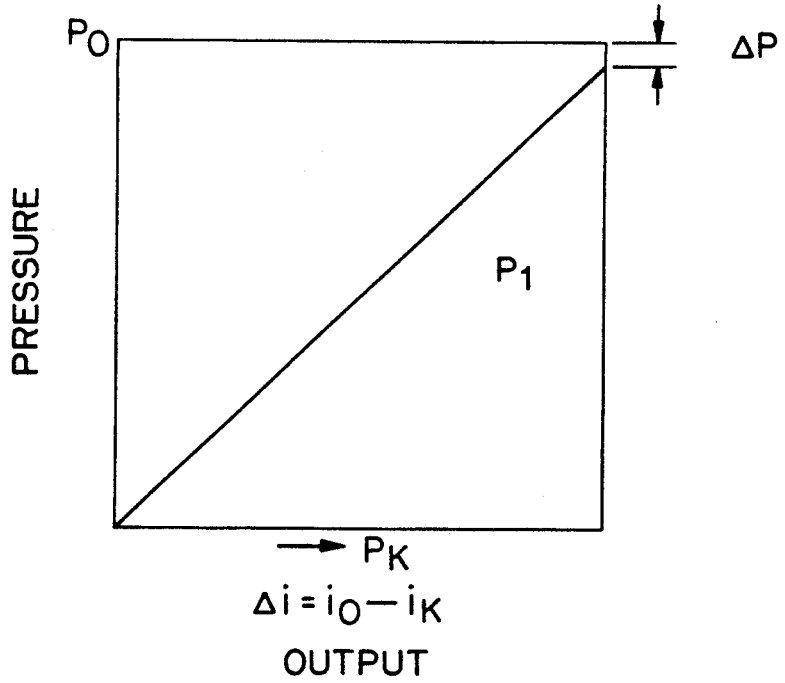
FIG. 5 is a pressure-output diagram of the prior art.

The internal efficiency of the full-arc admission steam turbine designed on the basis of the concept described above is plotted by the curve a of FIG. 3. Incidentally, this case corresponds to the design in which the maximum efficiency is established under a 85% load.

In this structure, the first blade stage group 7 is added to maintain the internal efficiency. Thus, the regulating valves of the steam pipings which are arranged in the blade stage groups can drastically reduce the drops of the internal efficiencies due to the throttle losses of the valves, which might otherwise be caused by the turbine of the prior art under the partial load. Since the valves are less throttled, the fluctuations of the chamber temperature with respect to the fluctuations of the load can be minimized.

The present invention can provide an full-arc admission steam turbine which can partly eliminate the defect of the prior art. This is accomplished by improving the internal efficiency, which normally drops under a partial load by the throttle loss of the valves, and allowing an internal efficiency no worse than that of a nozzle cut-off governing type steam turbine. Since, the blade stages are divided into a first and second blade stage groups and requires different stages, this invention require not only that the rotor but also the casing and the accompanying facilities be large-sized and strengthened. Thus, the cost for the hardware is increased by 1.5 to 2.0 times.

This added cost, however, can be compensated by the improvement in the internal efficiency, and by the temperature fluctuations under the partial load which can be reduced, thus reducing the lifetime consumption rate to zero. This makes it possible to provide a full-arc admission steam turbine which has its lifetime hardly influenced even if the load fluctuations are not limited between 70 to 100%. This is an outstanding effect over the aforementioned merits.

I claim:

1. A steam turbine of the full-arc admission type having maximize efficiency at both rated full output load and at a predetermined partial output load, said turbine comprising:

first and second blade stage groups arranged in cascade on a common rotor, each preceded by a respective full-arc chamber into which steam is introduced through first and second regulating valves, respectively, each of which is operative throughout a range from closed to fully open, the steam introduced through said first valve being successively expanded by said first and second blade stage groups and the steam introduced through said second valve being expanded in the second blade stage group to drive said rotor in rotation to generate power;

said second blade stage group having a number of blades of such length that when said second regulating valve is fully open said second blade stage group operates at maximum internal efficiency to generate said rated full output load; and said first blade stage group having a number of blades of such length as to compensate for such drops in internal efficiency of said second blade stage group as may occur due to operation at partial load for maintaining substantially the same internal efficiency when the turbine is operated at said predetermined partial output load as when it is operated at said rated full output load.

* * * * *